US007571796B2

(12) United States Patent
Stenzel et al.

(10) Patent No.: US 7,571,796 B2
(45) Date of Patent: Aug. 11, 2009

(54) METHOD AND APPARATUS FOR DETERMINING THE STATE OF BANK NOTES

(75) Inventors: Gerhard Stenzel, München (DE); Wolfgang Rauscher, München (DE)

(73) Assignee: Giesecke & Devrient GmbH, Munich (DE)

( * ) Notice: Subject to any disclaimer, the term of this patent is extended or adjusted under 35 U.S.C. 154(b) by 0 days.

(21) Appl. No.: 10/566,091

(22) PCT Filed: Jul. 20, 2004

(86) PCT No.: PCT/EP2004/008110

§ 371 (c)(1),
(2), (4) Date: Aug. 10, 2006

(87) PCT Pub. No.: WO2005/013207

PCT Pub. Date: Feb. 10, 2005

(65) Prior Publication Data

US 2007/0187209 A1 Aug. 16, 2007

(30) Foreign Application Priority Data

Jul. 31, 2003 (DE) ..... 103 35 147

(51) Int. Cl.
*G07F 7/00* (2006.01)
*G07F 7/04* (2006.01)

(52) U.S. Cl. ..... 194/206

(58) Field of Classification Search ..... 194/205, 194/206, 207
See application file for complete search history.

(56) References Cited

U.S. PATENT DOCUMENTS

| | | | | |
|---|---|---|---|---|
| 3,800,155 | A | 3/1974 | Potenza | |
| 5,992,600 | A * | 11/1999 | Baudat | 194/207 |
| 6,074,081 | A | 6/2000 | Smith et al. | |
| 6,101,266 | A | 8/2000 | Laskowski et al. | |
| 6,151,534 | A | 11/2000 | Smith et al. | |
| 6,234,294 | B1 * | 5/2001 | Defeo et al. | 382/135 |
| 6,741,727 | B1 * | 5/2004 | Hirasawa | 382/112 |
| 2002/0043560 | A1 | 4/2002 | Woods et al. | |
| 2006/0151282 | A1 | 7/2006 | Derks et al. | |

FOREIGN PATENT DOCUMENTS

| | | | |
|---|---|---|---|
| EP | 0 553 402 | A1 | 8/1993 |
| EP | 0 660 276 | A2 | 6/1995 |
| EP | 1 011 079 | A1 | 6/2000 |
| EP | 1 168 252 | A2 | 1/2002 |
| WO | WO 2004/0055740 | A2 | 7/2004 |

* cited by examiner

*Primary Examiner*—Patrick Mackey
*Assistant Examiner*—Mark Beauchaine
(74) *Attorney, Agent, or Firm*—Bacon & Thomas, PLLC

(57) ABSTRACT

The present invention relates to a method and apparatus for determining the state of bank notes.

Figure 1:
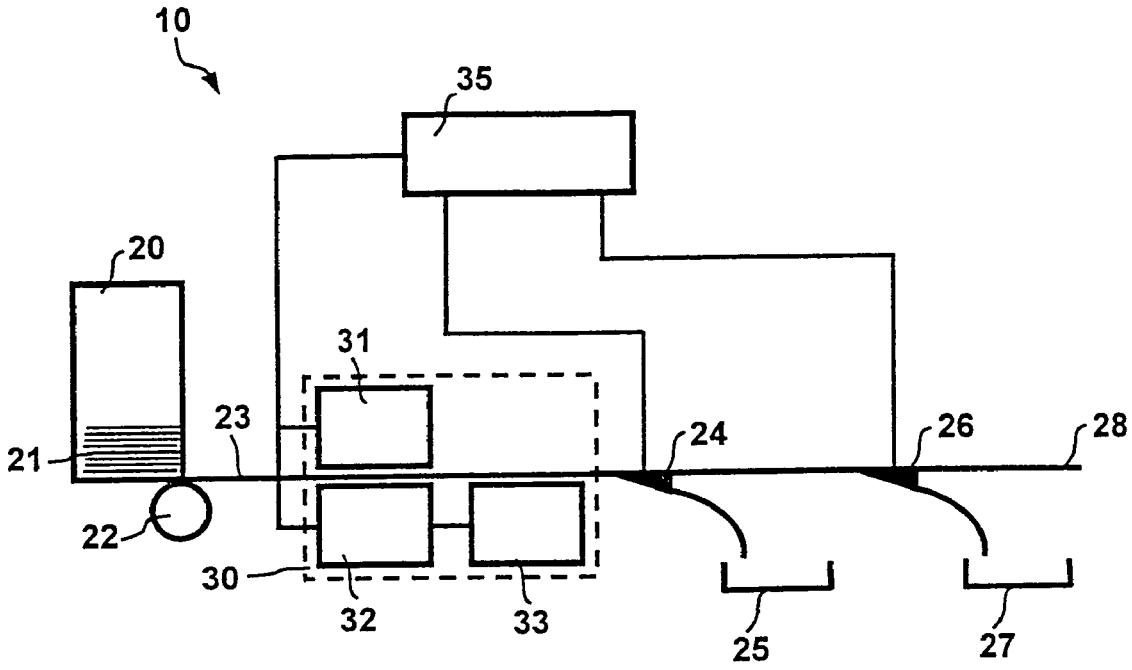

Determination of the state of bank notes by which data of at least two different properties of the bank notes are evaluated involves linking the data of the at least two different properties of each bank note with each other, and deriving the state of the bank note from the linked data of the different properties.

5 Claims, 1 Drawing Sheet

METHOD AND APPARATUS FOR DETERMINING THE STATE OF BANK NOTES

The present invention relates to a method and apparatus for determining the state (such as a condition of fitness or degradation) of bank notes.

Determining the state of bank notes is of great importance, since bank notes are divided up on the basis of the determined state into bank notes whose state is so good that these bank notes are suitable for further circulation and bank notes whose state is so bad that these bank notes are no longer suitable for further circulation. In bank note processing machines, determination of the state of bank notes is normally carried out by means of sensors that detect data representing certain properties of bank notes to be checked. From the properties such as soiling, spots, tears, holes, limpness, etc., the state of the bank notes can be determined.

In known methods and apparatuses, determination of the state of bank notes to be checked is done by threshold value comparisons of the data detected for the individual properties by the sensors. If the detected data are below the given threshold values for the individual properties, the state of the particular bank note is classified as good. If the detected data are above one or more of the given threshold values, the state of the particular bank note is classified as bad. Determination of the state of the bank notes is thus based on an evaluation of the data of each sensor or each property to be checked in isolation, i.e. independently of the data of the other sensors or properties.

It has turned out, however, that determination of the state of bank notes to be checked on the basis of an isolated evaluation, of the individual data of each sensor or property can lead to unsatisfactory results. If a bank note has for example a certain soiling that is altogether below the given threshold value for permissible soiling, and if moreover spots are present on the bank note that are for their part likewise below the given threshold value for permissible spots, the state of the bank note will be classified as good in the known method and apparatus. Due to the actual appearance of the bank note with soiling and spots, however, a viewer would classify the state of the bank note as altogether bad, so that determination of the state of the bank note by known apparatuses and methods is unsatisfactory.

It is therefore the problem of the present invention to specify a method and apparatus for determining the state (that is, a condition of fitness or degradation) of bank notes that permit improved determination of the state of bank notes.

This problem is solved according to the invention by the features of claims 1 and 6.

The invention starts out from a determination of the state of bank notes by which data of at least two different properties of the bank notes are evaluated, the data of the at least two different properties of each bank note being linked with each other and the state of the bank note derived from the linked data of the different properties.

The invention thus has in particular the advantage that the linkage of the properties characteristic of the state of the bank notes obtains an essential improvement in determination of state, since all properties important for the state of the bank notes are judged jointly, so that properties overlapping and/or influencing each other are no longer judged singly in isolation, but taken into account in the determination of the state of the bank notes in the way they influence the actual appearance of the bank notes.

Further advantages of the present invention can be found in the dependent claims and the following description of an embodiment with reference to a figure.

The single figure shows a schematic representation of a basic structure of an apparatus for determining the state of bank notes.

FIG. 1 shows a schematic representation of a basic structure of an apparatus 10 for determining the state of bank notes.

The apparatus 10 for determining the state of bank notes is formed as a bank note processing machine and has an input pocket 20 for inputting bank notes 21 to be processed, which is engaged by a singler 22. The singler 22 grasps one of the bank notes 21 to be processed at a time and transfers the single bank note to a transport system 23 which transports the single bank note through a sensor assembly 30.

The sensor assembly 30 has sensors 31, 32, 33, for example a first optical sensor 31 which detects light remitted by the bank note, a second acoustic sensor 33 which detects ultrasonic signals coming from, in particular transmitted by, the bank note, and a third optical sensor 32 which detects light transmitted by the bank note. The sensors 31, 32, 33, perform measurements for determining a state or condition of fitness or degradation of the bank notes by which they detect properties of each individual bank note and produce corresponding data. For this purpose the sensors 31, 32, 33 detect the bank notes with a certain resolution resulting in a pixel size with which the bank notes are scanned and detected.

From the detected pixels of each of the bank notes, data representing each place on the surface of the particular bank note are formed by the sensors 31, 32, 33 and/or a control device 35. Production of the data can be effected e.g. for one side of the bank notes, i.e. for one of the surfaces of the bank notes, or both surfaces can be detected and corresponding data provided. Preferably, the sides or surfaces of the bank notes are each detected completely and corresponding data produced for the complete side or surface.

From the data of the sensors 31, 32, 33 the control device 35 derives properties relevant for checking the bank notes. These properties characterize the state of the bank notes, such as soiling, spots, limpness, tears, adhesive tape, dog-ears, holes, missing parts of the bank notes, etc. The particular properties can be derived for example from the data of one or more of the sensors 31, 32, 33.

In the control device 35 the data of the sensors 31, 32, 33 are processed and compared with reference data stored in the control device 35, whereupon the control device 35 determines the state of the bank notes.

On the basis of the check of the particular bank note carried out by the control device 35, diverters 24, 26 disposed in the transport system 23 are driven, e.g. to deposit bank notes in good state in an output pocket 25, whereas bank notes in bad state can be deposited in an output pocket 27 or fed via the transport system 23 to further processing 28, e.g. destruction by means of a shredder.

As mentioned above, properties characterizing the state of the bank notes are derived from the data of the sensors 31, 32, 33. The individual properties and their derivation from the data of the sensors 31, 32, 33 will be explained more closely hereinafter.

Soiling of the bank notes is characterized by picking up the remission, primarily in unprinted areas of the bank notes. A measure of the soiling of the bank notes can thus be derived by the control device 35 from the data of the sensor 31 for example. The control device 35 can advantageously form an average for the remission values and/or the variance of the remission values.

Spots on the bank notes can be characterized by their surface area and/or the color contrast with the background. The surface area can be determined by the control device 35 for example by counting the above-described pixels of the sensor 31 that are covered by spots.

Limpness of the bank notes is characterized by their flexural stiffness. Limpness can be determined e.g. by evaluation of the signals of the ultrasonic sensor 33 by the control device 35, since ultrasound is scattered diffusely by limp bank notes.

Tears in the bank notes can be recognized by means of the sensor 32 which detects light transmitted by the bank notes. For characterizing the state of the bank notes, the control device 35 can determine for example the number of tears or the total length of the tears from the data of the sensor 32, in particular by counting the pixels.

Adhesive tape on the bank notes can be recognized by means of the sensor 31 which detects light remitted by the bank notes, the acoustic sensor 33 also being suitable. For characterizing the state of the bank notes, the control device 35 can determine for example the number of pieces of adhesive tape or the total length or total area of the pieces of adhesive tape from the data of the sensor 31 or 33, in particular by counting the pixels.

Dog-ears in the bank notes can be recognized by means of the sensor 32 which detects light transmitted by the bank notes. For characterizing the state of the bank notes, the control device 35 can determine for example the number of dog-ears or the total area of the dog-ears from the data of the sensor 32, in particular by counting the pixels.

Holes in the bank notes can be recognized by means of the sensor 32 which detects light transmitted by the bank notes. For characterizing the state of the bank notes, the control device 35 can determine for example the number of holes or the total area of the holes from the data of the sensor 32, in particular by counting the pixels.

Missing parts, e.g. security thread, hologram, etc., can likewise be recognized by one or more of the sensors 31, 32, 33. For characterizing the state of the bank notes, the control device 35 can determine for example the number of missing parts or the total area of missing parts from the data of the one or more sensors 31, 32, 33.

The above-described determination of the state of the bank notes by the control device 35 is brought about by the linkage of two or more of the ascertained and above-specified different properties of the bank notes. For this purpose, the individual different properties are each assigned a certain value characterizing the state. For example, a certain soiling is assigned a certain value. However, the same certain value can also be assigned to one or all other properties, so that e.g. a certain number of spots, a certain limpness, a certain number of tears, pieces of adhesive tape, dog-ears, holes, missing parts of the bank note, etc., is also assigned the certain value. The individual values are linked, for example by means of a linear combination. For determining the state of the bank notes, the control device 35 then compares the linear combination of the properties characterizing the state of the bank notes with a given value and decides for example whether the state of the bank notes is good or bad, i.e. whether they are fit for circulation or not. This permits a bank note that already has considerable soiling but in isolation not enough to result in the state of the bank note being determined as bad, to be determined as bad if the bank note additionally has e.g. only a few spots and/or tears, etc.

Obviously, a weighting can be carried out in the linear combination of the properties and/or the assignment of the values characterizing the state of the bank notes to the individual properties. Certain properties, e.g. tears or holes in the bank notes, may be weighted more strongly than other, less disturbing properties, e.g. dog-ears or spots. It is likewise obvious that other mathematical combinations can be used for evaluating the properties instead of a linear combination.

Besides the hitherto described sorting of bank notes according to state, it is also possible to evaluate the overall state of a certain set of bank notes. To this end, an average is formed from the linear combinations determined for the different properties. Likewise, an average can be formed for each or certain of the different properties of the certain set of bank notes, which then describes the state of this property for the certain set of bank notes. This can be of interest to a national bank, for example, since it permits it to get a general idea of the overall state or the state of certain qualities of the circulating bank notes.

Besides the described properties characterizing the state of individual bank notes, it can also be provided to include further properties in the determination of state that relate to more than one bank note. For example, it can be determined whether bank notes are connected by staples or whether a bundle of bank notes has poor stack quality or a height greater than an expected height.

For this purpose, it can be provided that sensors are disposed e.g. in the area of the input pocket 20 to determine e.g. the presence of staples or the height of the inserted bundle of bank notes 21. In the case of the height of the bundle, after the bundle has been processed by the bank note processing machine 10, i.e. when the number of bank notes 21 in the bundle is established, the height of the bundle determined in the input pocket 20 is compared with a height expected for the number of bank notes 21 forming the bundle. In the case that the number of bank notes 21 in the bundle is known, the height comparison can of course be done before the bank notes 21 are processed. The expected height can be determined by the control device 35 by multiplying the number of bank notes 21 by the known thickness of bank notes fit for circulation. If the height measured in the input pocket 20 is e.g. greater than the height determined from the number of bank notes 21 it can be inferred that the state of the bank notes 21 is bad, e.g. that the bank notes 21 are limp.

The invention has hitherto been described with reference to a bank note processing machine, but the invention can obviously be used wherever bank notes have to be judged with regard to state, e.g. also in cash deposit and dispensing machines, so-called recyclers.

Deviating from the description, it is also possible for the inventive apparatus to have a different structure. For example, instead of only one central control device 35, a control device can be provided in each sensor. In this case, the linkage of the data of the individual sensors is effected in one of the control devices of the sensors or in a central control device.

The invention claimed is:

1. A method for determining a condition of degradation of bank notes, comprising:

evaluating at least two different properties of a bank note, wherein the at least two different properties of the bank note relates to soiling, limpness, tears, adhesive tape, dog-ears, holes and missing parts of the bank note;

assigning, according to the evaluation of the data of the at least two different properties, a certain value to each property characterizing the condition of degradation of the respective property;

linking the values of the at least two different properties of each bank note with each other by calculating a linear combination of the values of the different properties, and deriving the condition of degradation of the bank note from a comparison of the linear combination of the different properties of the bank note with a given value; and processing the bank note in a bank note processing device according to the condition of degradation.

2. The method according to claim 1, wherein an average is determined for the values of each of the different bank notes to determine the condition of degradation of the set of bank notes for the particular different property.

3. The method according to claim 1, wherein an average is determined for the values of each of the different properties linked by means of the linear combination for a set of bank notes to determine the overall condition of degradation of the set of bank notes.

4. An apparatus for determining a condition of degradation of bank notes, comprising sensors for detecting data of at least two different properties of the bank notes, and a control device for determining the condition of degradation of the bank notes from the data of the at least two different properties of the bank notes, wherein the at least two different properties of the bank notes relate to soiling, limpness, tears, adhesive tape, dog-ears, holes or missing parts of the bank note, wherein the control device is arranged to evaluate the data of the at least two different properties of each bank note and to assign, according to the evaluation, a certain value to each property characterizing the condition of degradation of the respective property;

the control device is arranged to link the values of the at least two different properties of each bank note with each other by calculating a linear combination of the values of the different properties, and the control device is arranged to derive the condition of degradation of the bank note from a comparison of the linear combination of the different properties of the bank note with a given value.

5. The apparatus according to claim 4, wherein the apparatus comprises a hank note processing machine.

* * * * *